US007707951B1

(12) United States Patent
Prasad

(10) Patent No.: US 7,707,951 B1
(45) Date of Patent: May 4, 2010

(54) SYSTEM FOR PREVENTING CRIME IN HIGH TRAFFIC AREAS AND SITES USING LOW VOLTAGE POWER

(76) Inventor: Romeo Prasad, 144 E. Barber St., Windsor, CT (US) 06095

( * ) Notice: Subject to any disclaimer, the term of this patent is extended or adjusted under 35 U.S.C. 154(b) by 0 days.

(21) Appl. No.: 11/524,146

(22) Filed: Sep. 20, 2006

Related U.S. Application Data

(63) Continuation-in-part of application No. 10/375,398, filed on Feb. 27, 2003, now abandoned, which is a continuation-in-part of application No. 09/667,182, filed on Sep. 21, 2000, now abandoned.

(51) Int. Cl.
*E05G 1/00* (2006.01)

(52) U.S. Cl. ..... 109/30; 109/2; 109/3; 109/6; 109/8; 49/42

(58) Field of Classification Search ..... 109/2, 109/3, 6–8, 21, 30–32, 38; 49/42, 43
See application file for complete search history.

(56) References Cited

U.S. PATENT DOCUMENTS

| | | | | | |
|---|---|---|---|---|---|
| 2,186,385 | A | * | 1/1940 | Lockart | 292/33 |
| 2,378,492 | A | * | 6/1945 | Mallonee | 109/8 |
| 3,045,615 | A | * | 7/1962 | Atchison | 109/3 |
| 3,285,209 | A | * | 11/1966 | Pace | 109/8 |
| 4,060,039 | A | * | 11/1977 | Lagarrigue | 109/3 |
| 4,060,935 | A | * | 12/1977 | Miller et al. | 49/25 |
| 4,063,519 | A | | 12/1977 | Pretini | |
| 4,244,302 | A | * | 1/1981 | Stine | 109/2 |
| 4,308,803 | A | * | 1/1982 | Pretini | 109/3 |
| 4,534,131 | A | * | 8/1985 | Blackston et al. | 49/42 |
| 4,586,441 | A | | 5/1986 | Zekich | |
| 4,928,429 | A | * | 5/1990 | Colombo | 49/41 |
| RE33,407 | E | * | 10/1990 | Schwarz | 49/42 |
| 5,076,013 | A | * | 12/1991 | Gallenschutz et al. | 49/42 |
| 5,203,111 | A | * | 4/1993 | Huber et al. | 49/42 |
| 5,235,783 | A | * | 8/1993 | Huber et al. | 49/42 |
| 5,389,919 | A | * | 2/1995 | Warren et al. | 340/5.31 |
| 5,542,211 | A | * | 8/1996 | Colombo | 49/42 |
| 5,552,766 | A | | 9/1996 | Lee et al. | |
| 5,878,529 | A | * | 3/1999 | Huber | 49/68 |
| 6,367,198 | B1 | * | 4/2002 | Rockenbach | 49/42 |
| 6,484,650 | B1 | * | 11/2002 | Stomski | 109/6 |

(Continued)

*Primary Examiner*—Suzanne D Barrett
(74) *Attorney, Agent, or Firm*—BJ Associates; Bolesh J. Skutnik

(57) ABSTRACT

A substantially automatic, robotic-like system to aid in preventing crime in high trafficked buildings and other public sites, using only low voltage power, is described. In various modes it can protect public buildings such as schools, stadiums, open air markets, banks, office buildings from entrance of persons carrying weapons or separately trying to pass weapons into a protected area, even in the event of general power loss. Here a well designed, compact solution is provided for weapons detection and the detainment of persons attempting to disrupt, destroy or harm citizens in public buildings such as schools, banks, etc. with a minimum of restriction of access by persons regularly using the facilities. In other variations, it can be used to prevent unauthorized removal of costly or dangerous items from protected buildings or areas. Here a substantially automatic method is similarly provided for detection and detention of persons attempting to illegally remove items either without paying or that are not for sale in a store setting.

18 Claims, 1 Drawing Sheet

U.S. PATENT DOCUMENTS

| | | | | |
|---|---|---|---|---|
| 6,493,991 | B1 * | 12/2002 | Hamada et al. | 49/42 |
| 6,742,301 | B1 * | 6/2004 | Schwarz | 49/42 |
| 6,925,756 | B2 * | 8/2005 | Roessner et al. | 49/42 |
| 7,104,008 | B2 * | 9/2006 | Yokotachi | 49/42 |
| 7,119,682 | B1 * | 10/2006 | Fisher | 340/550 |
| 2003/0136052 | A1 * | 7/2003 | De Boer | 49/42 |
| 2003/0146347 | A1 * | 8/2003 | Roessner et al. | 244/129.5 |
| 2004/0006919 | A1 * | 1/2004 | Wild | 49/42 |
| 2005/0045078 | A1 * | 3/2005 | Chen | 109/8 |
| 2005/0238213 | A1 * | 10/2005 | Randazza et al. | 382/124 |
| 2005/0268557 | A1 * | 12/2005 | Huber | 49/42 |
| 2006/0150872 | A1 * | 7/2006 | Mesinger | 109/8 |

* cited by examiner

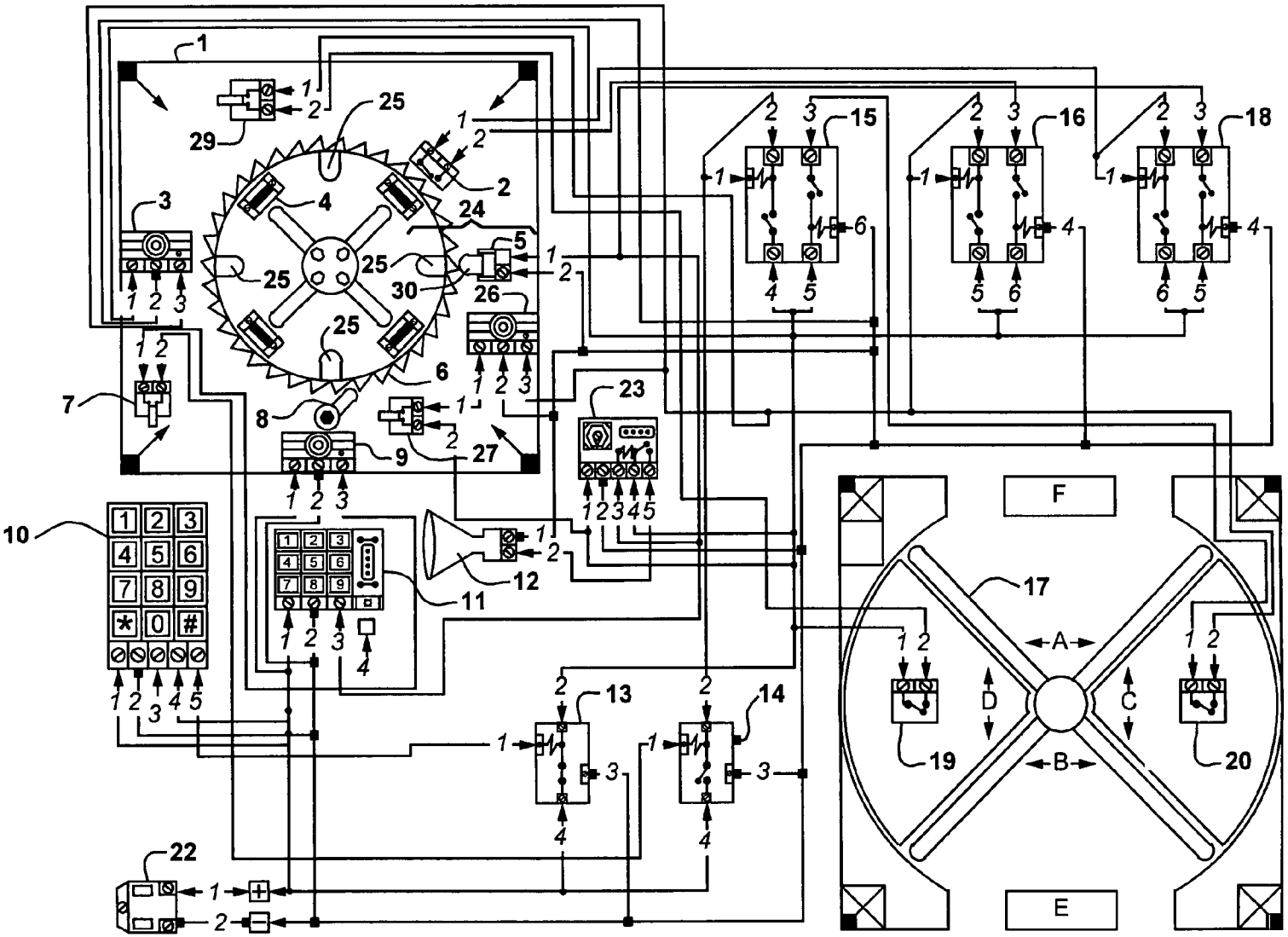
A
B
C
D
E
F

SYSTEM FOR PREVENTING CRIME IN HIGH TRAFFIC AREAS AND SITES USING LOW VOLTAGE POWER

PRIOR FILINGS

This application is a continuation-in-part and claims the benefit of U.S. application Ser. No. 10/375,398, filed Feb. 27, 2003 now abandoned by inventor Romeo Prasad and entitled "System for Preventing Crime in High Traffic Areas and Sites Using only Low Voltage Power" which itself was a continuation-in-part of U.S. application Ser. No. 09/667,182, filed Sep. 21, 2000 now abandoned by inventor Romeo Prasad and entitled "System for Preventing Crime in High Traffic Buildings", now abandoned, which are hereby expressly incorporated by reference into this application.

BACKGROUND OF THE INVENTION

1. Field of the Invention

The present invention is directed to providing automatic protection for highly trafficked buildings such as schools, stores, banks, warehouses, storage areas or other buildings from entry of weapons or of persons possessing weapons, or from illegal removal of merchandise. In particular, it deals with a low voltage system of electronic and mechanical equipment to robotically stop entry/exit and detain persons attempting to commit a crime in a protected area/building.

2. Prior Art Statement

There are many security systems to protect persons and buildings from criminals in the art. Many are called anti-crime or anti-robbery security systems. Generally they detect weapons on potential terrorists or criminals and alert some security force as to the entry of such person or persons. Often alarms are set off to deter action, but these give the perpetrator an opportunity to escape or capture hostages to trade for safe passage out.

Newer designs, like the silent alarms in banks, attempt to detect and alert personnel away from the entry/detection site without alerting the perpetrator. In many cases to detain a perpetrator, guards or other personnel have to activate precautionary measures to stop the criminal from departing but often at their own or bystanders' risk. Such systems are especially not optimal nor desirable for protecting school buildings or other public buildings where a general unsophisticated public may gather.

An alternative approach using a computer controlled double door enclosure and metal detecting sensors is described in U.S. Pat. No. 5,552,766 by Lee and Lee. Their anti-crime security system involves having the two doors enclose the area between the two doors. If the passageway and doors are small enough to restrict ingress and egress to one person at a time then problems with passing high traffic through the entry will be inherent to the system. Also the doors will both have to open out from the enclosure in order to permit the capture of a potential criminal within the enclosure. The latter also serves to restrict flow through the entry/exit. In a convenience store with its rather limited customer access, these problems can be tolerated. In a clothing store or a school or bank where often large numbers of people must pass through an entry or exit, these restrictions are not acceptable. If the restrictions are ameliorated than the security would be more easily compromised.

In another scheme when the area to be protected/secured is a known secure area, as in a military building, a nuclear power plant, a prison, or a weapon research center, there are systems which provide for selective access to secure regions from non-secure regions as in U.S. Pat. No. 4,586,441. Persons attempting to enter the secure area expect delay and some restriction on direct entry. For schools, banks and the like, i.e. places where it is not desirable nor completely feasible to stop and check every entrant all the time, even semi-automatic systems as described in U.S. Pat. No. 4,586,441 are not a solution. They would create almost a many problems as they would solve. For example, no one wants schools and banks and the like to feel like prisons. And yet in these often tumultuous times, it would be good to have ways to restrict the ingress and egress of persons trying to disrupt or threaten public places such as schools, etc.

An anti-robbery an anti-hostage equipment provided with a one-way rotating door for banks and the like was described by Pretini is U.S. Pat. No. 4,063,519. This particular systems of this patent involve multiple rotating doors and isolation passageways between them wherein detectors can probe persons attempting to enter the final protected area. The system is elaborate and its practicality even for banks is questioned since this patent is over 23 years old and, even though it no longer restrains use of its teachings, there is little or no evidence that such systems have ever been in use commercially.

In U.S. Pat. No. 4,341,165 (Calandritti et al.), it does teach of using a revolving door as a security system, with four zones and the ability to capture/detain a person who has tripped the weapon detectors. It also, however, teaches use of multiple electric motors to activate the doors, critically to close the sliding panel into the exit region when a weapon carrying intruder is detected, and to operate the detection system as well. This limits the operation and placement of the security system. It also contributes making the system costly initially and also in operation and use. In '165, the underlying structure is powered by multiple motors to which are used in conjunction with the detector in an elaborate system powered by a power grid as used in commercial electrical systems. It is the stopping of the motors driving the door panels which is crucial to detaining an intruder.

The present invention provides a low voltage powered, substantially automatic, detection and detention system to prevent crime in highly trafficked buildings or other sites, including where or when normal power is not readily or conveniently available.

SUMMARY AND OBJECTIVES OF THE INVENTION

It is an object of the present invention to provide a security system to prevent crimes within high traffic buildings and sites without the need for standard electrical power.

It is another object of the present invention to provide a security system to not only detect but also capture persons attempting to bring weapons into public buildings and sites, independent of normal electrical power.

It is an object of the present invention, in particular, to provide a substantially automatic compact security system for use in entries to banks or schools, including playing fields and the like.

It is a further object of the present invention to provide a space effective system to detect weapons on entering persons and to detain them before entry into the protected facility, without requiring attachment to power grids or high voltage sources.

It is yet another object of the present invention to provide an exit security system for controlled areas to aid in capture of persons attempting to flee from the area with a controlled/protected item or piece of merchandise.

It is also an object of the present invention to provide an exit security system for controlled areas to aid in capture of persons fleeing from a manually operated detection system, even when building power may be cut.

It is a still further object of the present invention to provide secured entry system which provides for substantially normal access to persons needing to use a public building, while detecting and detaining those trying to bring weapons into the facility or other public site, such as a stadium, playing field, etc.

Briefly stated the present invention provides a substantially automatic, robotic-like system to aid in preventing crime in high trafficked buildings and other public sites, using only low voltage power. In various modes it can protect public buildings such as schools, stadiums, open air markets, banks, office buildings from entrance of persons carrying weapons or separately trying to pass weapons into a protected area, even in the event of general power loss. Here the invention provides a well designed, compact solution to weapons detection and the detainment of persons attempting to disrupt, destroy or harm citizens in public buildings such as schools, banks, etc. with a minimum of restriction of access by persons regularly using the facilities. In other variations, it can be used to prevent unauthorized removal of costly or dangerous items from protected buildings or areas. Here the invention similarly provides a substantially automatic method of detection and detection of persons attempting to illegally remove items either without paying or that are not for sale in a store setting.

The above, and other objects, features and advantages of the present invention will become apparent from the following description read in conjunction with the accompanying drawing.

BRIEF DESCRIPTION OF FIGURES

FIG. 1 presents a schematic of the present invention wherein wire numbers are identified by their device and terminal numbers, e.g. for device 3, wires 3.1, 3.2 and 3.3. Crossing wires connect only where boxes are indicated.

DETAILED DESCRIPTION OF PREFERRED EMBODIMENTS

The key features of the present invention are a counterclockwise rotating door which permits access in one direction only and which may be manually operated always or in emergency conditions, two personnel detecting sensors, at least two other detectors, a low voltage power source and low voltage electronics, an electronic design to substantially automatically detect and detain persons attempting to enter a protected facility with a weapon or leave with a protected item, and where the entire security system is essentially contained within the space employed by the entry and or exit doorway. To obtain full protection from the system both entry and exit employ the one directional units. The basic system is hardwired for a specific site and use as described, for example, in the specific examples presented below. Where desired, a manually operating doorway systems maybe employed in conjunction with the present invention. Full computer control and capability to alter configurations by programming changes is envisioned as being within the scope of this disclosure. With an independent low voltage source the present system can maintain security even when in the midst of power failure to the surrounding and protected areas.

For security and safety reasons low voltage is used to power the electronics and the sensitivity of the weapons detector can be set or varied by authorized personnel. The digital key pad 10, switch 7 and the key pad of telephone transmitter 11, depicted in FIG. 1, can be attached onto a wall of the door unit within the protected area. This would permit manual activation from within the protected area. Alternatively, activation and position of these devices could be from some area remote to the door units.

Generally, each one way door unit is about 5-6 feet in maximum dimension. A double unit, providing an entry and an exit, would thus take up an area of about 6 feet deep by about 10 feet wide.

In the lower right hand corner of FIG. 1, the base of the rotating door assembly is presented with four identified zones, B, C, A, and D reading in a counterclockwise direction from the bottom. Zone B is the enter zone; a person can enter in this area only. Zone A is the exit zone; a person can exit in this area only. Zone C is the transfer and apprehension zone; a person can be apprehended, or a protected item detained in this area. Zone D is the dead zone; any time a person tries to enter this zone they are apprehended or alternatively hindered from entry. Switches 19 and 20 basically function as personnel detectors, which are closed when a person's weight is applied above them. They can also be set up to register movement of a door panel across either of them after another detector senses the presence of a protected item entering the zone, even if no one enters with the protected item.

The area in the upper left hand corner, contained within the lines bearing inward pointing arrows, represents the corresponding top view of the area above the rotating door assembly. Device 9 sits on an adjustable bracket essentially above areas D, E and C depicted in the base section of the FIGURE. The position of device 9 can be adjusted to permit monitoring of area C or of area D. Devices 3 and 5 lie essentially above the center of zones D and C respectively. Detector 26 is positioned above the entry to zone C. Flywheel 6 is shown to have teeth oriented for one directional rotation when flywheel lever 8 is engaged. If flywheel level 8 is disengaged, as might be the case in a fire emergency, the revolving door could be allowed to freely rotate permitting exit from through an entry door.

Where the entrance and exit are positioned at the 'front' and 'rear' of a protected area the orientation of the two follow as shown in FIG. 1. At the entrance the entry is from zone B outside the protected area into zone A within the protected area, while for the exit zone B is within the protected area and the exit zone A is outside the protected area. Where the entrance and exit are positioned essentially side by side, the exit unit will be rotated by 180 degrees so that the two dead zones, $D_{entrance}$ and $D_{exit}$ are adjacent to each other. In either case each unit operates essentially the same with the entrance unit not permitting exit through it and the exit unit not permitting entry or re-entry through it.

By running all the detection, apprehension and detention components on low voltage, the security system can be used independent of exterior power permitting use in remote or temporary sites without power access, or in cases where the electrical power has been compromised or fails.

The following detailed descriptions help exemplify the invention in conjunction with FIG. 1 but do not represent all the possible variations that might be used within the scope of the scope of the invention.

Example 1

Person entering a school or bank with a weapon

As a person reaches area E when device 9 is main RF detector, 9 detects a weapon on the person and sends an electronic signal from point 9.3 through normally closed switch 7 to trigger relay 14 at point 14.1. Next normally open relay 14 closes and reopens causing current flow from point 14.2 to latching relay 15 at point 15.1. Latching switch 15 is latched continuously and current flows from point 15.3 to point 20.1 of normally open apprehension switch 20. As the person enters zone C switch 20 is closed (activated) and current flows from point 20.2 to latching relay 16 at Point 16.1.

Latching relay 16 is latched continuously and then current flows from point 16.3 to normally open flywheel magnetic switch 2 as a door panel 17 rotates to timing apprehension position shown by the lower right hand static structure, and mechanically depicted in the upper left quadrant by having plunger 30 enter cylinder 25, denoted as 24. Normally open magnetic switch 2 activates (closes) and current flows from point 2.2 to latching relay 18 at point 18.1.

Latching relay 18 is continuously latched and current flows from point 18.3 to magnetic lock 5 at point 5.1, to time delay switch 23 at point 233 and to telephone transmitter 11 at point 11.3. Magnetic lock 5 locks flywheel 6 by inserting its plunger 30 into cylinder 25 preventing further rotation of the door from its timing apprehension position. The person is trapped within zone C. Telephone transmitter 11 calls 911 or a predetermined internal security number. Siren 12 sounds for 5 minutes or some other pre-selected time period.

The detained person can be released when the proper 4 digit code is entered into key pad 10. Key pad point 10.5, which normally open, is closed and current flows to reset relay 13 at point 13.1. Normally closed relay 13 opens and recluses disturbing the current flow to latching relays 15, 16, and 18. Magnetic lock 5 is unlocked by the withdrawal of its plunger 30 from cylinder 25 and the door may now rotate to allow the person to exit in zone A.

Note that all aspects of the present invention can preferably be powered by a self-contained low voltage battery source similar to an automotive style 12 volt battery. The panels of the door unit can be operated manually, if the site to be protected can not be conveniently electrified, connected to a power grid. Also by not relying on the power used by the door unit in operation, the security system can be used even if general power has been lost or purposely shut off. In general for use in high traffic areas, entry/exits would need to have a release of powered restraint to permit orderly access during an emergency. The present invention would not have to release a captured person nor be made inactive without specific, conscious action by operators/monitors, simply because a general power loss occurred.

Alternative Example 1

Person entering with a weapon.

In the case where device 9 is not an RF detector, as a person passes from area E through zone B into zone C, RF detector 26 detects a weapon on the person and sends an electronic signal from point 26.3 to latching relay 16 at point 16.1. Also as the person enters zone C switch 20 is closed (activated) and current flows from point 20.2 to latching relay 16 at point 16.1. At this point the remainder of Example 1 proceeds from its second paragraph.

Example 2

Person tries to enter/exit with or without a weapon from zone A. This might include a person trying to re-enter after passing through a one-way exit.

A person enters zone A from area F. The one way feature does not permit entry into zone C from zone A. The door panel 17 can be moved towards zone D when the person steps into zone D always energized switch 19 is closed and current flows from point 19.2 to latching relay 16 at point 16.1.

Latching relay 16 is latched continuously and then current flows from point 16.3 to normally open flywheel magnetic switch 2 as a door panel 17 rotates to timing apprehension position shown by the lower right hand static door structure, and mechanically shown in the upper left quadrant as the combination of plunger 30 entering cylinder 25, denoted as 24. Normally open magnetic switch 2 activates (closes) and current flows from point 2.2 to latching relay 18 at point 18.1.

Latching relay 18 is continuously latched and current flows from point 18.3 to magnetic lock 5 at point 5.1, to time delay switch 23 at point 23.3 and to telephone transmitter 11 at point 11.3. Magnetic lock 5 locks flywheel 6 by inserting its plunger 30 into cylinder 25 preventing further rotation of the door. The person is trapped within zone D. Telephone transmitter 11 calls 911 or a predetermined internal security number. Siren 12 sounds for 5 minutes or some other pre-selected time period.

The detained person can be released as described in Example 1 above, except that here the person will be freed into zone B.

Example 3

Person tries to leave through a secured exit with a protected item.

Device 9 is configured as an electromagnetic detector or as a RF receiver. Zone E is positioned inside a store or other protected building/area. As a person reaches area E electromagnetic detector, 9 detects a magnetic strip attached to a protected item, e.g. a full length leather or fur coat, on the person and sends an electronic signal from point 9.3 through normally closed switch 7 to trigger relay 14 at point 14.1. Alternatively where device 9 is a RF receiver, an employee or guard noticing a person attempting to leave with a protected item can transmit a signal to receiver 9 and the device 9 sends an electronic signal from point 9.3 above.

Next normally open relay 14 closes and reopens causing current flow from point 14.2 to latching relay 15 at point 15.1. Latching switch 15 is latched continuously and current flows from point 15.3 to point 20.1 of normally open apprehension switch 20. As the person enters zone C switch 20 is closed (activated) and current flows from point 20.2 to latching relay 16 at point 16.1.

Latching relay 16 is latched continuously and then current flows from point 16.3 to normally open flywheel magnetic switch 2 as a door panel 17 rotates to timing apprehension position shown by the lower right hand static door structure. Normally open magnetic switch 2 activates (closes) and current flows from point 2.2 to latching relay 18 at point 18.1.

Latching relay 18 is continuously latched and current flows from point 18.3 to magnetic lock 5 at point 5.1, to time delay switch 23 at point 23.3 and to telephone transmitter 11 at point 11.3. Magnetic lock 5 locks flywheel 6 by inserting its plunger 30 into cylinder 25 preventing further rotation of the door. The person is trapped within zone C. Telephone transmitter 11 calls 911 or a predetermined internal security number. Siren 12 sounds for 5 minutes or some other pre-selected time period.

The detained person can be released when the proper 4 digit code is entered into key pad 10. Key pad point 10.5, which normally open, is closed and current flows to reset relay 13 at point 13.1. Normally closed relay 13 opens and recluses disturbing the current flow to latching relays 15, 16, and 18. Magnetic lock 5 is unlocked by the withdrawal of its plunger 30 from cylinder 25 and the door may now rotate to allow the person to exit in zone A.

Alternative Example 3

Person tries to pass protected item through exit.

Here the basic plan works the same, except for the following changes. The item moving from area E into zone B is detected by detector 9. The leading door panel activates switch 20 and the protected item alone is detained within zone C as the magnetic lock 5 locks flywheel 6.

Example 4

Person tries to pass a weapon into the building from a protected exit by fastening it to a door panel.

A person in zone A, which is outside the building or protected area, fastens in some manner a weapon onto door panel 17 to provide it to an accomplice within the protected area. As door panel 17 rotates into zone D, RF detector 3 detects the weapon and sends an electronic signal to latching relay 16 at point 16.1.

Latching relay 16 is latched continuously and then current flows from point 16.3 to normally open flywheel magnetic switch 2 as a door panel 17 rotates to timing apprehension position shown by the lower right hand static door structure. Mechanically corresponds to plunger 30 entering cylinder 25, denoted as 24. Normally open magnetic switch 2 activates (closes) and current flows from point 2.2 to latching relay 18 at point 18.1.

Latching relay 18 is continuously latched and current flows from point 18.3 to magnetic lock 5 at point 5.1, to time delay switch 23 at point 23.3 and to telephone transmitter 11 at point 11.3. Magnetic lock 5 locks flywheel 6 by inserting its plunger 30 into cylinder 25 preventing further rotation of the door. The weapon is trapped within zone D. Telephone transmitter 11 calls 911 or a predetermined internal security number. Siren 12 sounds for 5 minutes or some other pre-selected time period.

The detained weapon can be released when the proper 4 digit code is entered into key pad 10. Key pad point 10.5, which normally open, is closed and current flows to reset relay 13 at point 13.1. Normally closed relay 13 opens and recluses disturbing the current flow to latching relays 15, 16, and 18. Magnetic lock 5 is unlocked by the withdrawal of its plunger 30 from cylinder 25 and the door may now rotate to allow the retrieval of the weapon from zone B.

In all cases when there is no theft or entry/exit with an unauthorized weapon the ingress or egress is as facile as entry into general office building or hotel through a freely revolving door. Passage by authorized personnel carrying weapons can be made possible either by prior keying in of appropriate codes into keypad 10 or using computer programming to temporarily override the circuitry in conjunction with an entry of a proper code into the controlling computer.

Having described preferred embodiments of the invention with reference to the accompanying drawings, it is to be understood that the invention is not limited to these precise embodiments, and that various changes and modifications may be effected therein by one skilled in the art without departing from the scope or spirit of the invention as defined in the appended claims.

What is claimed is:

1. A substantially automatic, compact, robotic-like, security system for preventing crime in high traffic buildings comprising:

at least one revolving door unit;

a geared flywheel fixed to said revolving door unit, wherein the geared flywheel in operation restricts rotation of the revolving door unit in an anti-clockwise direction only;

a semi-circular inside wall, wherein the at least one revolving door unit includes two pairs of door panels that revolve within the semi-circular wall, and the two pairs of door panels define at least four zones;

said at least four zones including, in operation, at least two zones defining independent isolated chambers, wherein each independent isolated chamber is formed by two door panels and said inside semi-circular wall;

four equidistant plunger accepting cylinders attached to said geared flywheel;

one plunger attached to a fixed section of said semi-circular wall;

wherein a respective timing apprehension position of the revolving door unit is defined each time a respective plunger accepting cylinder is located opposite a plunger;

a low voltage electromechanical subsystem including at least two personnel detectors, below said revolving doors, which are activated by personnel stepping over them; and at least two other detectors positioned to scan within said independent isolated chambers; and a substantially automatic means for electromechanically stopping said revolving door, without alerting person within revolving door, only when (i) a timing apprehension position of said revolving door unit is achieved and (ii) a signal is received from one or more of said detectors, for thwarting an illegal activity, which when stopped forms said independent isolated chambers from which access/exchange with an open chamber is not achievable.

2. The substantially automatic security system according to claim 1, further comprising at least one additional plunger, wherein each of the plungers is affixed at the center of a respective zone along said semi-circular wall, and said timing apprehension position is achieved when plunger accepting cylinders are located opposite at least two respective plungers.

3. The substantially automatic security system according to claim 1, wherein at least one detector of said at least two other detectors is a radio frequency (RF) weapon detector positioned above an entry way of said revolving door unit's at least four zones;

two of said revolving door unit's at least four zones are dead zones permitting no entry without at least one of detection and apprehension;

wherein each of said dead zones excludes the possibility of passing a weapon through by a person in said dead zone, and a person in said dead zone cannot receive aid in doing so from someone inside said protected area; and wherein said door panels use transparent material.

4. The substantially automatic security system according to claim 3, wherein said low voltage electromechanical subsystem comprises a series of latching relays, magnetic switches and a magnetic lock, which apprehends a person entering said revolving door unit while possessing a weapon.

5. The substantially automatic security system according to claim 1, wherein one detector of said at least two other detectors is an electromagnetic detector, capable of detecting magnetic tape attached to a protected article, and which is positioned above an exit way; and at least one zone of said revolving door unit's at least four zones is a dead zone permitting no uninterrupted passage, and wherein said door panels use at least one of shatter proof glass and plastic.

6. The substantially automatic security system according to claim 5, wherein said low voltage electromechanical subsystem comprises a series of latching relays, magnetic switches and a magnetic lock, which apprehends a person entering said revolving door unit while possessing a protected merchandise item within one of said independent isolated chambers.

7. The substantially automatic system for protecting buildings according to claim 5, wherein said low voltage electromechanical subsystem comprises a series of latching relays, magnetic switches and a magnetic lock, which captures a protected merchandise item in one of said independent isolated chambers even without being accompanied by a person.

8. The substantially automatic security system according to claim 1, further comprising a radio frequency (RF) receiver to activate said security system upon receiving a signal from a RF transmitter positioned away from said at least one revolving door unit.

9. The substantially automatic security system according to claim 1, wherein said at least one revolving door unit functions as an entry to a high traffic building/remote site independent of any power grid.

10. The substantially automatic security system according to claim 9, wherein, prior to detection of a potential illegal activity, general public is provided substantially unfettered entrance to and egress from a protected area.

11. The substantially automatic security system according to claim 5, wherein said at least one revolving door unit functions as an exit to a high traffic building.

12. The substantially automatic security system according to claim 1, wherein said high traffic building/remote site is protected at both entry and exit by at least one said revolving door unit in each area.

13. The substantially automatic security system according to claim 1, wherein entrance and egress require no electrical power, and wherein detection and capture require no exterior electrical power beyond that of said low voltage subsystem.

14. The substantially automatic security system according to claim 1, wherein electrical power for said low voltage subsystem is by means of a self-contained low voltage battery.

15. The substantially automatic security system according to claim 14, wherein said self-contained low voltage source is an automotive-style 12V DC battery.

16. The substantially automatic security system according to claim 1, wherein said system is essentially portable for temporary deployment at remote sites experiencing high traffic and a need for security.

17. The substantially automatic security system according to claim 3, wherein the transparent material is at least one of bullet proof glass and bullet proof plastic.

18. The substantially automatic security system according to claim 5, wherein the uninterrupted passage is entry without apprehension/detention.

* * * * *